US006707052B1

(12) United States Patent
Wild et al.

(10) Patent No.: US 6,707,052 B1
(45) Date of Patent: Mar. 16, 2004

(54) INFRARED DECEPTION COUNTERMEASURE SYSTEM

(76) Inventors: Norman R. Wild, 15 Beasom St., Nashua, NH (US) 03060; Paul M. Leavy, Jr., 29 Huckleberry Rd., Lynnfield, MA (US) 01940

( * ) Notice: Subject to any disclaimer, the term of this patent is extended or adjusted under 35 U.S.C. 154(b) by 0 days.

(21) Appl. No.: 04/255,916

(22) Filed: Feb. 7, 1963

(51) Int. Cl.[7] ..... F41Q 7/22; F41H 11/02; H04K 3/00

(52) U.S. Cl. ..... 250/504 R; 342/14

(58) Field of Search ..... 343/18, 7, 7.4, 343/7.5; 250/203, 83.3 IR, 199, 504 R; 88/1 FP; 244/14.3, 14; 342/14

(56) References Cited

U.S. PATENT DOCUMENTS

| | | | | |
|---|---|---|---|---|
| 2,369,622 | A | * | 2/1945 | Toulon |
| 2,997,595 | A | * | 8/1961 | Cary et al. |
| 3,025,515 | A | * | 3/1962 | Fairbanks |
| 3,076,961 | A | * | 2/1963 | Bibbero |
| 3,108,270 | A | * | 10/1963 | Fairbanks |
| 3,150,848 | A | * | 9/1964 | Laser |
| 3,161,375 | A | * | 12/1964 | Ruhge |

* cited by examiner

*Primary Examiner*—Nelsoon Moskowitz

(57) ABSTRACT

The invention is a defense unit countermeasure system comprising an attack unit detector to activate an attack illuminator, a modulated CW radiation source, a radiation detector, a second signal generator and modulator.

20 Claims, 2 Drawing Sheets

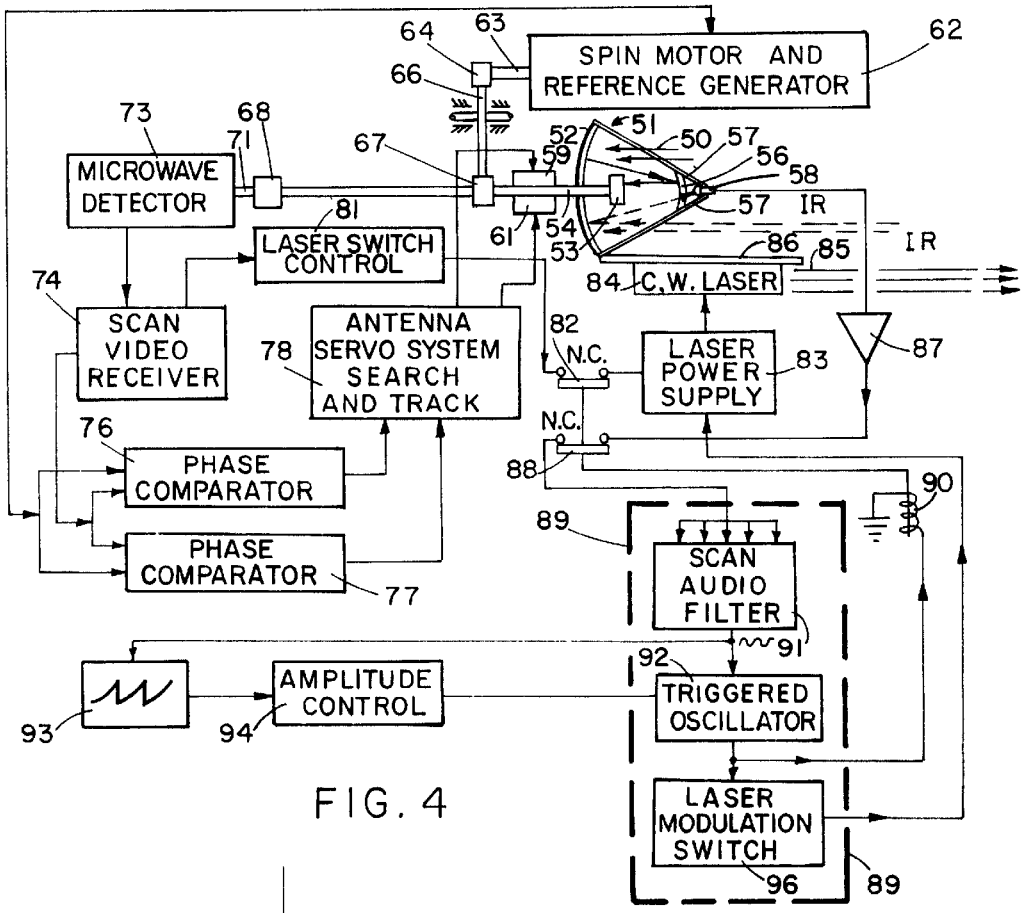
FIG. 4
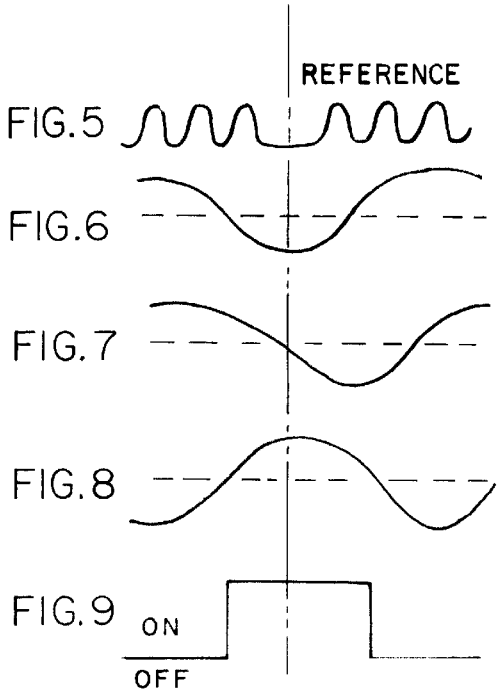

INFRARED DECEPTION COUNTERMEASURE SYSTEM

This invention relates to a countermeasures system for detecting and diverting an attacking unit.

When penetrating enemy territory under conditions of limited warfare, bombers suffer attack from enemy aircraft vectored by radar. These aircraft attack the bombers with air-to-air missiles which employ both microwave and infrared homing systems. Currently bombers of this class have increased their penetration capability by employing electronic countermeasures system to deny the attacking missiles accurate radar position data. In the past, infrared countermeasures systems have been employed in an attempt to deceive infrared homing systems by employing the use of flares or decoys, which provide the homing system with an incorrect angle of attack. These approaches suffer shortcomings such as having an insufficient power in the right portion of the spectrum and lacking a sufficient duration of burning time coupled with inherent break-away problems from the launching aircraft to be defended. Other problems have been encountered with the use of decoys because of their limited time of flight and the absence of an exact knowledge as when to launch, plus the over-all problem of carrying sufficient quantities of such decoys.

The purpose of this invention is to obviate the problems that have arisen in the prior art. This countermeasures systems is basically comprised of an enemy attack detection device which may be an active or passive system. The countermeasures system in responding to the presence of the attacking enemy produces a radiation as for example light which illuminates the attack unit, which, in turn, reflects a portion of the radiation. The reflected radiation is received by the countermeasures system, analyzed and information in signal form so received is used to control the characteristics of a radiation directed at the attack unit to thereby deceive the homing controls in the attack unit and divert the attack unit's direction.

Specifically, the basic function of the system in a preferred embodiment is the location of an attacking aircraft which is the missile carrier by passive electronics countermeasures or infrared techniques followed by illumination of the attacking aircraft with a continual laser beam. The next step requires the examination of the frequency pattern of the light reflected from spinning reticule or scanner in the missile head while the missile is on the plane and the last step requires the modulation of the laser beam with the appropriate frequency pattern and phase shift so that a false target is seen by the missile. The missile, accordingly, will attack this false target when it is launched. As soon as it has turned sufficiently to move the false target out of its field of view, the missile will also have lost the airplane. Since it cannot reacquire and has limited turning rates, the missile will wander and appear erratic thus aborting its mission. The attacking aircraft being unable to see the modulated infrared laser beam will conclude that the missile was defective. It is therefore seen that this new system is capable of acting as a continuously operable countermeasures system capable of denying angular information to infrared seekers employing spinning reticule direction finding techniques.

An object of this invention, therefore, is to deceive homing type attacking missiles by illuminating the missile with a false target signal.

Another object of this invention is to deceive an aircraft carrying a missile into believing there has been some malfunction in the missile by using a target error signal which is invisible to the aircraft's pilot.

Yet another object of this invention is to establish a compact countermeasures system incorporating a modulatable electromagnetic generator as a target error signal source.

Yet another object is to provide defense for aircraft against attacking missiles employing homing guidance as described that is completely automatic and does not require an operator.

Yet another object of this invention is to provide an efficient lightweight countermeasure system requiring relatively low power drain from the aircraft power supply uniquely adapting it for airborne use.

Yet another object of this invention is to provide angle deception for passive guidance systems of the type generally known to those skilled in the art as LORO (lobe on receive only).

Other objects, features and advantages will become apparent after consideration of the following detailed specification together with the appended drawings, in which FIG. 1 illustrates an aircraft being pursued by aircraft carrying an attack missile.

FIG. 4 shows a schematic of a countermeasures system in its preferred embodiment.

FIG. 5 represents a missile infrared video output.

FIG. 6 illustrates a missile integrated error signal from its infrared video output.

FIG. 7 shows a missile reference generator signal.

FIG. 8 depicts a countermeasures displaced oscillator signal.

FIG. 9 illustrates a laser modulator output.

Figure 1:
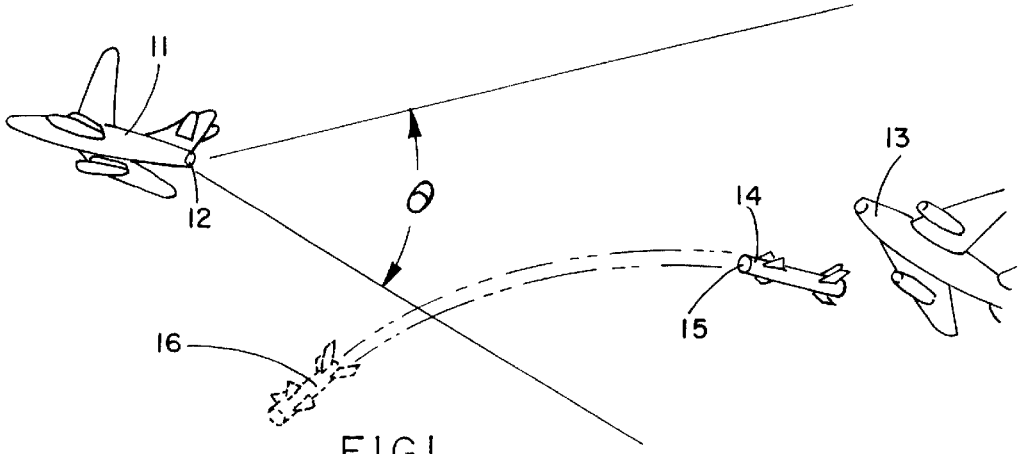

Referring now to FIG. 1 where there is illustrated an aircraft 11 which is being pursued by an attacking aircraft 13 (partially shown), directly beneath the attacking aircraft 13 is illustrated a missile 14 of the air-to-air type which has just been launched from attacking aircraft 13. Located in the rear of the defendant aircraft 11 is a deceptive infrared countermeasures system 12 which responds to the presence of the attacking aircraft 13 and emits a signal which is received by the missiles target signal generator 15 which causes the missile 14 to follow a doted path 10 into a diverted position 16.

In order to obtain an understanding of the countermeasures system 12 and its effect on the target signal generator 15, a study of a typical target signal generator will be made with reference now to FIG. 2, in which there is shown one form of a target signal generator. A complete and definitive description of this type of target signal generator may be had by a study of U.S. Pat. No. 3,034,405, titled "Multislit Scanner". This type of target signal generator consists of a modified Cassegrain telescope having a spherical reflector 23 provided with an opening 24 in the center and a plane reflector 21 which is mounted on reflector support 31 by narrow supports 22. Spherical reflector 23 is likewise secured to the reflector support 31. A rotor 29 is supported for rotation about axle 28 by anti-friction bearings 32. Axle 28 is mounted on reflector support 31 which in turn is mounted in a conventional manner. Scanner 26 which is alternately referred to a reticule is mounted on rotor 29 at the focal plane of the telescope and photosensitive detector 27 is mounted on axle 28. The Cassegrain telescope comprising spherical reflector 23 and plane reflector 21, scanner 26, and photosensitive detector 27 constitute the target signal generator 15.

Photosensitive detector 27 in a preferred example is formed of lead sulphide the resistance of which varies inversely with the intensity of incident radiation. The Cassegrain telescope focuses radiation from sources within the view of the telescope onto scanner 26. The scanner 26 rotates with the rotor 29 at a spin frequency determined by a driving spin motor and reference generator 36, which is illustrated as driving the rotor 29 via the drive shaft 34 and a drive member 33. The incident radiant energy falling on scanner 26, is chopped by the scanner in a manner to be described and variations in the intensity of the incident radiation falling on detector 27 are transmitted to amplifier 37.

The infrared missile seeker 15 noted above is of the homing type and represents a serious threat because of its high accuracy to aircraft in moderately clear weather conditions. The homing mechanisms of these seekers operate near the region of near infrared and their detectors, e.g., 27 are most sensitive at wavelengths of 1 to 3 microns.

Figure 2:
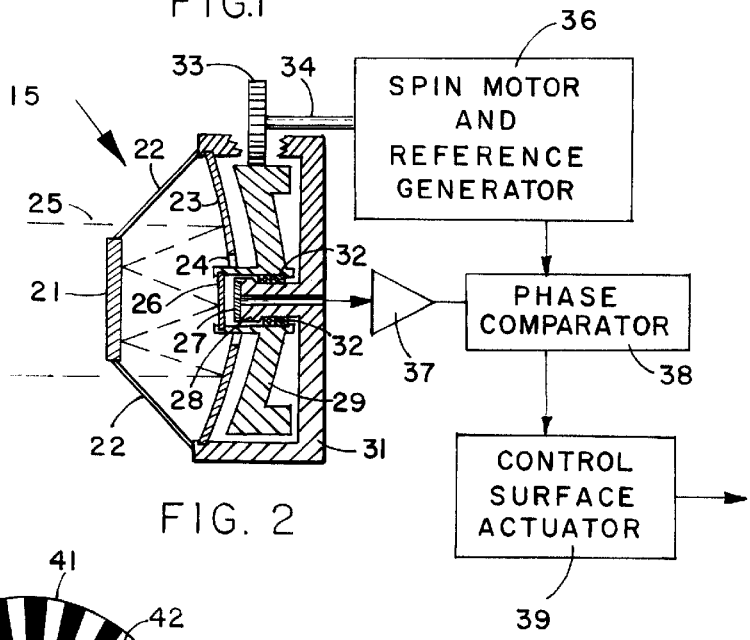
FIG. 2 is a schematic of a multislit scanner.

Because of the short wavelengths used it is apparent from FIG. 2 that the optics of this system are small in size and offer high resolution accounting for the high performance obtained. The seeker described is purely passive and requires no transmitter because it homes on the exhaust heat of its target's aircraft, in this case, as shown in FIG. 1, defense aircraft 11. As noted above when infrared energy is reflected by a primary reflector, namely, spherical reflector 23, to a plane reflector 21, it then passes through a central portion 24 of the spherical reflector. The reflected infrared energy simultaneously passes through a spinning scanner 26 such as that illustrated in FIG. 3. This spinning reticule or scanner 26 affords discrimination against clutter such as clouds and sunlight and provides the basic direction finding information. The scanner 26 is spun by the spin motor reference generator 36 by the arrangement described above. After the infrared energy has passed through the scanner 26, the energy has been chopped because of the scanner's structural configuration. This chopped energy strikes the photosensitive detector 27. The key to the operation of this system is the spinning scanner 26 which is driven by the spin motor reference generator combination 36.

Figure 3:
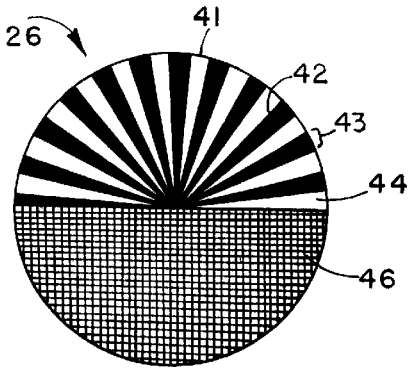
FIG. 3 depicts a typical multislit scan element.

Referring now to FIG. 3, where there is shown a typical scanner 26, which consists of an infrared transparent material upon which is evaporated a metallic film pattern such as an opaque sector 42. In the scanner 26 depicted it is seen to consist of two semi-circular sectors 41 and 46. Sector 41 is for target sensing and is comprised of a plurality of slits 43, each slit 43 consisting of a transparent sector 44 and an opaque sector 42. Sector 46 is for indicating the phase of the signal generated by the target sensing sectors and is semi-transparent so as to permit one half of the radiant energy falling on the phasing sector to be transmitted. It should be noted that the pattern on the scanner 26 may take a variety of designs. In its operation at any instant of time, a true target will consist of a point lying wholly within one segment of the scanner 26 while clutter would intersect more than one segment of the scanner 26. In this manner the seeker can discriminate between a true target and clutter.

The system is typically a null seeking system and when the target is in the center of the scanner 26 no chopped signal gets through. However, as the target moves further away from the center of the scanner an increasing chopped signal passes into the photosensitive detector 27 and to an amplifier 37 to yield an error signal.

As the scanner spins a cyclic chopped pattern is detected. The phase of the cyclic chopped pattern from the scanner depicted is compared by a phase comparator 38 when the phase of the reference generator signal to produce an angle correction voltage, in the same manner as the error signal is compared with a reference generator signal and a conical scanning radar. This angle correction voltage is fed to a control surface actuator 39 which steers the missile. In this manner the missile knows in which direction to correct its aiming error in order to hit the target. In this case, defense aircraft 11. The relationship of the target signal generator and the signals produced therein with the signals sent from a countermeasures system 12 will be described more fully hereafter.

Referring now to FIG. 4 where there is schematically illustrated a countermeasures system that represents one embodiment of applicants' invention. This system 12 is located in the rear of defense aircraft 11 and in order that this embodiment of the system be described a number of presumptions must be kept in mind throughout the study of the system, namely, that the attacking aircraft will be located somewhere within a solid angle θ, FIG. 1, centered dead astern. This, of course, does not preclude the location of another system of the same type in the forward part of the aircraft to detect missiles approaching from that direction or for that matter the system may be located at any of a number of positions on the defense aircraft 11. It should also be kept in mind that in this embodiment the attacking aircraft 13 will be within some reasonable range, for example, 5,000 yards, when the enemy aircraft decides to launch the missile. At launch time the attacking aircraft will be emanating microwave radiation such as that from an aircraft ranging only radar or an airborne intercept radar. It is to be understood that while the system will be described in terms of a passive detection of enemy aircraft, the system may operate with the use of an active enemy detection system of either an infrared or microwave type.

In view of the foregoing examples, we can now turn to FIG. 4 in which the countermeasures system employs a small microwave parabolic antenna 51 which function is to receive both aircraft ranging only radar signals 50 and simultaneously receive infrared signals in a manner to be described more fully hereafter. As the attacking aircraft 13 approaches, the microwave parabolic antenna 51 receives the aircraft ranging only radar signals 50 and reflects them in a manner shown to a conically scanned element such as a triscanner 53, which, in turn, permits their passage via radiator 54, rotary joint 68 to a detector 73. In order that microwave parabolic antenna 51 be capable of receiving both aircraft ranging only signals and infrared signals, there is supported on the boresight axis of the reflector an infrared lens with a microwave grating 56 supported by support rods 57. The infrared lens with a microwave grating permits the passage infrared energy while reflecting the microwave energy back to the tri-scan element. These reflected radar signals 50 must pass through the rotating tri-scan element 53 which tri-scan element 53 receives its rotary drive from a spin motor and reference generator 62 via drive shaft 63 and drive elements 64, 66 and 67.

The rotary joint 68 permits radiator 54 and its integrally attached tri-scan element 53 to rotate independently of microwave conduit 71 and the rest of the system. The microwave energy reflected from parabolic reflector 52 and microwave grating 56 passes through the radiator 54 and into a microwave detector 73, which in turn feeds the information to scan video receiver 74. The microwave parabolic antenna 51 is continually conically scanning and searching the aforementioned cone in the stern direction due to the rotary drive of tri-scan element 53 brought about by spin motor 62 whose operation was noted above.

In order that the antenna 51 continually search and track the output of the scan video receiver 74 is fed to phase comparators 76 and 77, which are simultaneously receiving the output of the spin motor and reference generator 62, the phase comparators 76 and 77 compare the phase of the error signal from the scan video receiver 74 with the phase of a signal from the reference generator which is directly coupled with the spin motor which conically scans the antenna.

The output of the phase comparators 76 and 77 are fed to an antenna servo search and track system 78 which has a search and track programmer and suitable amplifiers to increase the voltage from the phase comparators 76, 77 to control respectively the up-down slew motor 59 and the right-left slew motor 61, which maintain the microwave antenna 51 in a continuous search and track path of the attacking aircraft 13. It is therefore apparent that this arrangement will permit the system to accurately track the enemy aircraft in angle by tracking an aircraft ranging only signal.

Upon reception and tracking of this aircraft ranging only signal, this system would assume that the enemy was preparing to launch an infrared homing missile and the infrared deceptive jamming would be then initiated in the following manner. As soon as the microwave energy of the aircraft ranging only radar signal 50 is detected by microwave detector 73 and fed to the scan video receiver 74, an output from the scan video receiver 74 would instantly activate laser switch control 81 whose output signal would pass through a normally closed switch 82 to activate a laser power supply, the output of which would activate a continually operable laser.

The desirability of using a laser light source resides in the fact that such lasers offer the property of emitting essentially monochromatic, phase coherent light energy in the near infrared portion of the spectrum. Monochromatic light output known as stimulated emission of radiation makes the infrared beam emerge from the laser with phase coherence so that a collimated beam is obtained without the use of auxiliary optics. Because the beam is essentially monochromatic and collimated, power densities per solid angle may be obtained which are many times higher than can be obtained with any other known type of optical frequency generator. A continually operable laser that may be used in the instant application relies on trivalent neodymium in calcium tungstate. The laser is fully described in the following publication: "Physical Review" May 15, 1962, Vol. 126, No. 4, by L. F. Johnson, on pages 1406 to 1409. A modulatable xenon lamp suitable for modulating the aforementioned laser is described in the September, 1962, issue of *Illuminating Engineering*, at pages 589–591. Laser modulation techniques are further discussed in the publication, *Electronics* for Nov. 10, 1961, at pages 83–85. Other types of lasers which are modulatable to perform the function stated herein are the diode type laser as described in the publication, *Electronics* for Oct. 5, 1962, at pages 44–45.

It should be noted that while one laser light source is illustrated the system could function with two lasers. One laser to give continual operation and a second to give a modulated output. The discussion while directed to lasers as a light source is not meant to exclude other light sources of sufficient power and having frequency components at the correct wavelength.

The laser 84 in its now activated condition would emit a collimated beam of monochromatic infrared energy 85 aimed at the attacking aircraft and its infrared homing missile. The laser or laser beam director 84 is integrally attached by laser support member 86 to parabolic reflector 52. Because of the integral physical relationship of the laser its beam will inherently follow the search and track function of the conically scanning microwave antenna 51, and accordingly illuminate the attacking aircraft and missile simultaneously with the microwaves antenna tracking operation. Because of the early detection ranges of the microwave detector 73 this, of course, occurs prior to the attacking aircraft 13 launch of its air-to-air missile 14. The infrared beam 85 emitted by the laser 84 is received by the target signal generator 15 in the missile 14 head. This beam is chopped and reflected by the spinning scanner 26, recollimated by the spherical reflector 23 and transmitted back to the parabolic reflector 52 of the microwave antenna 51. This collimated reflected and chopped beam of infrared energy is then reflected by the parabolic reflector 52 and detected by the photosensitive detector 58 mounted on support rods 57. It is therefore apparent that the signal produced by the photosensitive detector 58 will represent the frequency of modulation of the infrared beam as reflected by the rotating scanner. This output signal from the photosensitive detector 58 is amplified by audio amplifier 87 and fed through a normally closed switch 88 to generator 89 which has a scan audio filter 91. The scan audio filter may be a comb filter of resonant reeds in which the reed which is resonant at the scanners spin frequency gives an output from the scan audio filter 91 at the correct spin frequency which starts at a random initial phase with respect to the attacking missiles scanner phase. The scan audio filter 91, in the example given, being of the comb filter type having resonant reeds in which the reed which is resonant at the scanner's spin frequency has the inherent characteristic of maintaining an output signal for a definite period of time after its input signal is removed. Digital and analog devices to determine frequency may also be used. This phase shifted scanner spin frequency signal is fed to a triggered oscillator 92. This triggered oscillator 92, for example, may be controlled by a sawtooth generator 93 and an amplitude control device 94. The amplitude control device may be a Schmitt trigger, which has the property that an output of constant peak value is obtained for the time period that the input wave form exceeds a specific voltage. It is important for reasons to be explained hereafter that the output from the triggered oscillator 92 function for a distinct period of time, then cease its output for another distinct period of time to provide look-through period for a check of the scanners spin frequency, before repeating the signal. As mentioned above this is controlled by the sawtooth generator 93 and the amplitude control device 94, which controls the oscillator 92 so it is turned ON and OFF for the proper intervals. This check of the scanners spin frequency is needed to determine any changes in the spin frequency and also to prevent ring-around between the laser 84 and the detector 58 or the system from locking up on its own modulation. This action takes place because the receiver is deactivated during transmission by the look-through process just described. The sawtooth generator 93 which is activated by the output from the scan audio filter produces a signal whose voltage increases with the passage of time until the Schmitt trigger of the amplitude control device 94 is activated at which time an output is noted from the amplitude control 94 which in turn triggers the oscillator 92 to pass the phase shifted scanner frequency detected by the scan audio filter 91. The output from the oscillator 92 is illustrated in FIG. 8. The output from the triggered oscillator 92 simultaneously actuates a laser modulation switch 96 and solenoid 90 which opens normally closed switches 82 and 88 which act to turn off the laser power supply 83 and the related laser 84. It will be seen that as the circuit between laser switch control 81 and the laser power supply 83 is broken by the opening of switch 82, the laser power supply is simultaneously activated by the actuation of laser modulation switch 96 which results in the emission of a modulated infrared beam 85 from laser 84. Laser modulation switch produces a square wave shown in FIG. 9, which modulates the laser 84 at the spin rate of the missiles scanner. The laser modulation switch may include for example a rectifier to obtain only one polarity to be delivered to a power amplifier which controls a grid which in turn controls the laser modulation. This phase shifted modulated signal from the laser is now directed at the enemy's target signal generator 15 and brings about an angle deception by interchannel cross-coupling which will be discussed more fully hereafter.

The transmitted beam of monochromatic infrared energy 85 illuminates a volume of space much larger than the attacking aircraft. Energy will be reflected from portions of the airplane and from the reflected portions of the scanner in the target signal generator 15. The energy reflected by the rotating scanner will be modulated at a rate determined by the number of reflected segments, their width and the spin rate of the spin motor 36, FIG. 2. Energy will also be reflected from the missile's detector 32 since it is coated to be nonreflected in the wavelength region of maximum detector performance and will consequently be more reflective than it otherwise would be at the wavelength of the laser beam. The difference in reflectivity between the detector and the scanner comprises the signal source of the ac signal received at the microwave antenna 51 in the defending aircraft. The photosensitive detector 58 in the countermeaures system will have incorporated therein a narrow band filter placed in front of it (not shown). Hence, because only a narrow wavelength region is used and because the signal to be detected from the missile is chopped, strong dc signals from clouds, sunlight, attacking aircraft itself and exhaust from the defending aircraft will be reduced to negligible portions.

The signal from detector 58 which contains the modulation components from both halves of the scanner 26, FIG. 3, is passed to amplifier 87 which filters out the high frequency components from the upper half of the scanner 41, leaving an error signal from the lower half of the scanner 46, thus the output of the video amplifier 87 contains signal information directly related to the missile scanner rotational frequency.

As noted earlier there arises a relationship between an error signal in the target signal generator 15, FIG. 2, and the spin motor reference generator 36.

Referring now to FIGS. 5, 6, and 7, there is shown in FIG. 5, a typical missile infrared video output which is shown in its integrated form as a sine wave in FIG. 6, and represents an integrated error signal from the infrared video output.

FIG. 7 illustrates the missile reference generator signal from reference generator 36. The reference generator 36 may either be a sine wave generator or an impulse generator. For purposes of convenience, a sine wave output has been shown in FIG. 7. Since the infrared seeker compares the phases of FIG. 6 vs that shown in FIG. 7, and uses the output of its phase comparator 38 to activate the control surfaces of air-to-air missile 14 in order to give false information to such a system all that has to be done is to shift the phase of the error signal with respect to the reference generator signal. As described above, the laser beam 85 will be a square wave modulated at the scanner spin frequency and at some random phase with respect to the true target error signal phase of the spinning scanner. Since the laser beam 85 represents a strong signal which is displaced in time phase as compared to the target signal, the jamming signal represented by a square wave depicted in FIG. 9, will be shifted as shown in FIG. 9 with respect to the true error signal when compared with phase of the reference generator signal as shown in FIG. 7. Hence false angle information is presented to the missile seeker system as a large error signal and will cause the missile threat to veer off from the true heading at some random false heading.

It should be clearly understood that the invention is not limited to the infrared portion of the electromagnetic spectrum, but is broadly applicable to any system using guidance systems employing spinning scanning direction finding techniques regardless of what portion of the electromagnetic spectrum is involved.

While there has been hereinbefore described what are considered preferred embodiments of the invention, it will be apparent that many and various changes and modifications may be made with respect to the embodiments illustrated, without departing from the spirit of the invention. It will be understood, therefore, that all changes and modifications as fall fairly within the scope of the present invention as defined in the appended claims are to be considered as part of the present invention.

What is claimed is:

1. A countermeasures system arranged to deceive an attack unit as said attack unit approaches a defense unit, said attack unit having a reflecting medium which when illuminated will reflect modulated radiation due to movement and discontinuities in said reflecting medium, said countermeasures system comprising, (a) a defense unit having
  (1) an attack unit detecting means
  (2) a radiation source capable of modulated and continuous operation
  (3) means responsive to a signal produced by said attack unit
  (4) detecting means to activate said radiation source to illuminate said attack unit when said attack unit is detected by said detecting means.

(b) a radiation detection means responsive to said modulated radiation reflections of light from said attack unit producing output signals, (c) a generator arranged to provide a second signal at the modulation frequency of said output signals from said detection means and with a phase different from that of said detection means output (d) means modulating said radiation source in accordance with said second signal.

2. A countermeasures system as defined as claim 1 in which said radiation source is a laser.

3. A countermeasures system as defined in claim 1, which has in combination a search and track means to control said defense units detecting means.

4. A countermeasures system as defined in claim 3 in which said detecting means and said radiation source are operably connected to move in unison under control of said search and track means.

5. A countermeasures system as defined in claim 1 which has in combination means for deactivating said radiation detection means from said generator during the period of transmission of said second signal modulated output, thereby obviating the problem of ring-around.

6. A countermeasures system as defined in claim 1 wherein means are provided to deactivate said modulation generator from said radiation source for brief periods while said attack unit detecting means and related illumination means maintain said generators modulation frequency accuracy with respect to said reflected modulated radiation from said attack unit.

7. A countermeasures system arranged to deceive an attack unit which emits energy as said attack unit approaches a defense unit, said attack unit having a reflecting medium which when illuminated will reflect modulated radiation due to movement and discontinuities in said reflecting medium, said countermeasures system comprising, (a) a defense unit having
  (1) an energy detection means
  (2) a radiation source capable of modulated and continuous operation
  (3) means responsive to a signal produced by said energy detection means to activate said radiation source to illuminate said attack unit when energy is received from said attack unit, (b) a radiation detection means responsive to said modulated reflections of radiation from said attack unit, (c) a generator arranged to provide a second signal at the modulation frequency of the output of said detection means and with a phase different from that of said detection means output (d) means modulating said radiation source in accordance with said second signal.

8. A countermeasures system as defined in claim 7 in which said radiation source is a laser.

9. A countermeasures system as defined in claim 7 which has in combination a search and track means to control said defense units energy detecting means.

10. A countermeasures system as defined in claim 9 in which said energy detecting means and said radiation source are operably connected to move in unison under control of said search and track means.

11. A countermeasures system as defined in claim 7 which has in combination means for deactivating said radiation detection means from said generator during the period of transmission of said second signal modulated output, thereby obviating the problem of ring-around.

12. A countermeasures system as defined in claim 7 wherein means are provided to deactivate said modulation generator from said radiation source for brief periods while said attack unit detecting means and related illumination means maintain said generators modulation frequency accuracy with respect to said reflected modulated radiation from said attack unit.

13. A countermeasures system for use against a missile having a guidance system employing an optical system and a reflective scanner comprising, (a) radiant energy means for illuminating said missile scanner, (b) radiant energy detecting means for receiving said energy reflected from said scanner containing missile target signal generator data, (c) circuit means for deriving said data from said reflected energy, (d) circuit means for generating deceptive target signal generator data based on said derived data, (e) and means for modulating a radiant energy source in accordance with said deceptive data to thereby cause the missile to be deflected from its target.

14. A countermeasures system for use against a missile having a guidance system employing an optical system and a reflective spinning reticle comprising:

(a) radiant energy means for illuminating said missile reticle, (b) radiant energy detecting means for receiving said energy reflected from said reticle containing missile target signal generator data, (c) circuit means for deriving said data from said reflected energy, (d) circuit means for generating deceptive target signal generator data based on said data, (e) and means for modulating a radiant energy source in accordance with said deceptive data to thereby cause the missile to be deflected from its target.

15. A countermeasures system for use against a missile having an infrared guidance system employing an optical system and a reflective spinning reticle comprising, (a) infrared energy means for illuminating said missile, (b) infrared energy detecting means for receiving said energy reflected from said reticle containing target signal generator data, (c) circuit means for deriving said data from said reflected energy, (d) circuit means for generating deceptive target signal generator data based on said derived data, (e) and means for modulating an infrared energy source in accordance with said deceptive data to thereby cause the missile to be deflected from its target.

16. A countermeasures system for use against a radiant energy seeking missile having a guidance system utilizing an image seeking system employing mechanical motion comprising, (a) a source of radiant energy for illuminating the image seeking system of said missile, (b) radiant energy detecting means for receiving said reflected energy from said image seeking system containing missile target signal generator information, (c) circuit means for deriving said information contained in said reflected energy from said missile image seeking system, (d) circuit means for generating deceptive target signal generator data based on said derived information compatible with said derived information data, (e) and means for modulating a radiant energy source in accordance with said deceptive data to thereby deceptively control said guided missile.

17. A method of defense against a missile of the heat or radiant energy seeking type utilizing a guidance system having an image seeking system employing mechanical motion which comprises, (a) illuminating said missile with radiant energy, (b) detecting said energy reflected from said image seeking system, (c) deriving missile target signal generator information from said reflected radiant energy, (d) generating deceptive target signal generator information derived from said information, (e) and illuminating said missile with radiant energy containing said deceptive missile target signal information.

18. A method of defense against a missile of the heat or radiant energy seeking type utilizing a guidance system having an optical system and a reflective spinning reticle which comprises, (a) illuminating said missile with radiant energy, (b) detecting said energy reflected from said spinning reticle, (c) deriving missile target signal generator information from said reflected radiant energy, (d) generating deceptive target signal generator information derived from said information, (e) illuminating said missile with radiant energy containing said deceptive missile target signal information.

19. A countermeasures system for use against radiant energy seeking missile having a guidance system utilizing an image seeking system employing mechanical motion said countermeasure system being separate from said missile comprising, radiant energy means for illuminating said missile image system, and detecting means for recovering radiant energy reflected from said missile image seeking system containing missile target signal generator information.

20. A countermeasures system for use against radiant energy seeking missile having a guidance system employing an optical system and a reflective spinning reticle said countermeasure system being separate from said missile comprising, radiant energy means for illuminating said missile reticle, and detecting means for recovering radiant energy reflected from said missile reticle containing missile target signal generator information.

* * * * *